US009121250B2

(12) United States Patent
Godfrey et al.

(10) Patent No.: US 9,121,250 B2
(45) Date of Patent: Sep. 1, 2015

(54) REMOTELY OPERATED ISOLATION VALVE

(75) Inventors: Craig W. Godfrey, Dallas, TX (US); Neal G. Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 504 days.

(21) Appl. No.: 13/308,309

(22) Filed: Nov. 30, 2011

(65) Prior Publication Data

US 2012/0234558 A1 Sep. 20, 2012

(51) Int. Cl.
*E21B 34/10* (2006.01)
*E21B 47/12* (2012.01)

(52) U.S. Cl.
CPC ..... *E21B 34/10* (2013.01); *E21B 47/12* (2013.01)

(58) Field of Classification Search
CPC ..... E21B 34/16
USPC ..... 166/255.1
See application file for complete search history.

(56) References Cited

U.S. PATENT DOCUMENTS

| | | | | |
|---|---|---|---|---|
| 3,500,952 | A | 3/1970 | Beeken | |
| 3,780,809 | A * | 12/1973 | Ayers et al. | 166/374 |
| 4,574,889 | A | 3/1986 | Pringle | |
| 4,579,177 | A | 4/1986 | Going, III | |
| 4,606,416 | A | 8/1986 | Knighton et al. | |
| 4,617,960 | A * | 10/1986 | More | 137/554 |
| 4,768,594 | A * | 9/1988 | Akkerman | 166/319 |
| 5,238,070 | A | 8/1993 | Schultz et al. | |
| 5,249,630 | A | 10/1993 | Meaders et al. | |
| 5,257,663 | A | 11/1993 | Pringle et al. | |
| 5,531,270 | A | 7/1996 | Fletcher | |
| 6,017,198 | A | 1/2000 | Traylor et al. | |
| 6,041,864 | A * | 3/2000 | Patel et al. | 166/332.4 |
| 6,142,226 | A | 11/2000 | Vick | |
| 6,152,232 | A | 11/2000 | Webb et al. | |
| 6,167,974 | B1 | 1/2001 | Webb | |
| 6,199,629 | B1 | 3/2001 | Shirk et al. | |
| 6,257,549 | B1 * | 7/2001 | Hopper | 251/129.11 |
| 6,298,767 | B1 | 10/2001 | Porter | |

(Continued)

FOREIGN PATENT DOCUMENTS

WO 0118357 A2 3/2001

OTHER PUBLICATIONS

International Search Report with Written Opinion issued Sep. 28, 2011 for PCT Patent Application No. PCT/US11/029116, 9 pages.

(Continued)

*Primary Examiner* — Jennifer H Gay
*Assistant Examiner* — Steven MacDonald
(74) *Attorney, Agent, or Firm* — Chamberlain Hrdlicka

(57) ABSTRACT

A method of operating an isolation valve can include continuously transmitting a signal to a detector section, and a control system operating an actuator in response to the detector section detecting cessation of the signal transmission. A well system can include an isolation valve which selectively permits and prevents fluid communication between sections of a wellbore, a remotely positioned signal transmitter, and the isolation valve including a control system which operates an actuator in response to detection of a signal by a detector section. Another well system can include an isolation valve interconnected in a tubular string, and the tubular string being cemented in a wellbore, with cement being disposed in an annulus formed radially between the isolation valve and the wellbore.

22 Claims, 12 Drawing Sheets

(56) References Cited

U.S. PATENT DOCUMENTS

| | | | | |
|---|---|---|---|---|
| 6,343,649 | B1 | 2/2002 | Beck et al. | |
| 6,343,658 | B2 | 2/2002 | Webb | |
| 6,419,022 | B1 | 7/2002 | Jernigan et al. | |
| 6,557,637 | B1 | 5/2003 | Dore et al. | |
| 6,659,186 | B2 | 12/2003 | Patel | |
| 6,684,950 | B2 | 2/2004 | Patel | |
| 6,719,057 | B2 | 4/2004 | Johansen | |
| 6,851,481 | B2 | 2/2005 | Vinegar et al. | |
| 6,957,703 | B2 | 10/2005 | Trott et al. | |
| 6,962,215 | B2 | 11/2005 | Curtis et al. | |
| 6,988,556 | B2 | 1/2006 | Vick, Jr. | |
| 7,152,688 | B2 | 12/2006 | Richards | |
| 7,178,600 | B2 | 2/2007 | Luke et al. | |
| 7,273,102 | B2 | 9/2007 | Sheffield | |
| 7,614,454 | B2 | 11/2009 | Buyers et al. | |
| 7,665,527 | B2 | 2/2010 | Loretz | |
| 2002/0108747 | A1* | 8/2002 | Dietz et al. | 166/66.7 |
| 2003/0019622 | A1 | 1/2003 | Goodson | |
| 2003/0150622 | A1 | 8/2003 | Patel et al. | |
| 2003/0155131 | A1 | 8/2003 | Vick, Jr. | |
| 2004/0129424 | A1 | 7/2004 | Hosie et al. | |
| 2004/0251032 | A1 | 12/2004 | Luke et al. | |
| 2005/0230118 | A1 | 10/2005 | Noske | |
| 2005/0263286 | A1 | 12/2005 | Sheffield | |
| 2006/0124318 | A1 | 6/2006 | Sheffield | |
| 2006/0157255 | A1 | 7/2006 | Smith | |
| 2006/0191681 | A1 | 8/2006 | Storm et al. | |
| 2007/0012457 | A1 | 1/2007 | Curtis et al. | |
| 2007/0295504 | A1 | 12/2007 | Patel | |
| 2008/0135235 | A1 | 6/2008 | McCalvin | |
| 2009/0218096 | A1* | 9/2009 | Vick et al. | 166/250.15 |
| 2013/0000922 | A1 | 1/2013 | Skinner et al. | |

OTHER PUBLICATIONS

Weatherford; "DDV: Downhole Deployment Valve", Article No. 335.01, dated 2005-2010, 4 pages.

Weatherford; "Managed Pressure Drilling, Downhole Deployment Valve Enable Drilling of Big-Bore Gas Wells in Sumatra", Article No. 2831.03, dated 2007-2010, 2 pages.

International Search Report and Written Opinion issued Jan. 20, 2011 for International Patent Application Serial No. PCT/US2010/28574, 10 pages.

International Search Report and Written Opinion issued Mar. 17, 2011 for International Patent Application Serial No. PCT/US2010/28576, 10 pages.

Office Action issued Aug. 8, 2011 for U.S. Appl. No. 13/046,728, 10 pages.

Office Action issued Feb. 10, 2005 for U.S. Appl. No. 10/426,917, 13 pages.

Office Action issued Jul. 13, 2005 for U.S. Appl. No. 11/180,140, 9 pages.

Office Action issued Feb. 7, 2014 for U.S. Appl. No. 13/490,936, 7 pages.

Notice of Allowance issued Feb. 13, 2014 for U.S. Appl. No. 13/046,730, 18 pages.

International Preliminary Report on Patentability and Written Opinion issued Jan. 24, 2008 for PCT Application No. PCT/US12006/023947, 6 pages.

Pes, "Model DV Dual Control Line Operated Drill Through Lubricator Valve", marketing document, dated Jul. 27, 2001, 6 pages.

Weatherford, "Underbalanced Drilling: Undeniable Success", product article, dated Mar. 2002, 1 page.

Weatherford, "Products and Services Catalog", brochure #01.01, dated 2002, 3 pages.

Weatherford, "A Year of Milestones for Your Company", annual report, dated 2002, 7 pages.

Halliburton, "Quik-Trip™ Valve", product specifications, H02856R, dated Apr. 2002, 2 pages.

* cited by examiner

REMOTELY OPERATED ISOLATION VALVE

CROSS-REFERENCE TO RELATED APPLICATION

This application claims the benefit under 35 USC §119 of the filing date of International Application Serial No. PCT/US11/29116, filed 19 Mar. 2011. The entire disclosure of this prior application is incorporated herein by this reference.

BACKGROUND

The present disclosure relates generally to equipment utilized and operations performed in conjunction with a subterranean well and, in an embodiment described herein, more particularly provides a remotely operated isolation valve.

It is frequently desirable to isolate a lower section of a wellbore from pressure in an upper section of the wellbore. For example, in managed pressure drilling or underbalanced drilling, it is important to maintain precise control over bottomhole pressure. In order to maintain this precise control over bottomhole pressure, an isolation valve disposed between the upper and lower sections of the wellbore may be closed while a drill string is tripped into and out of the wellbore.

In completion operations, it may be desirable at times to isolate a completed section of a wellbore, for example, to prevent loss of completion fluids, to prevent damage to a production zone, etc.

DETAILED DESCRIPTION

Figure 1:
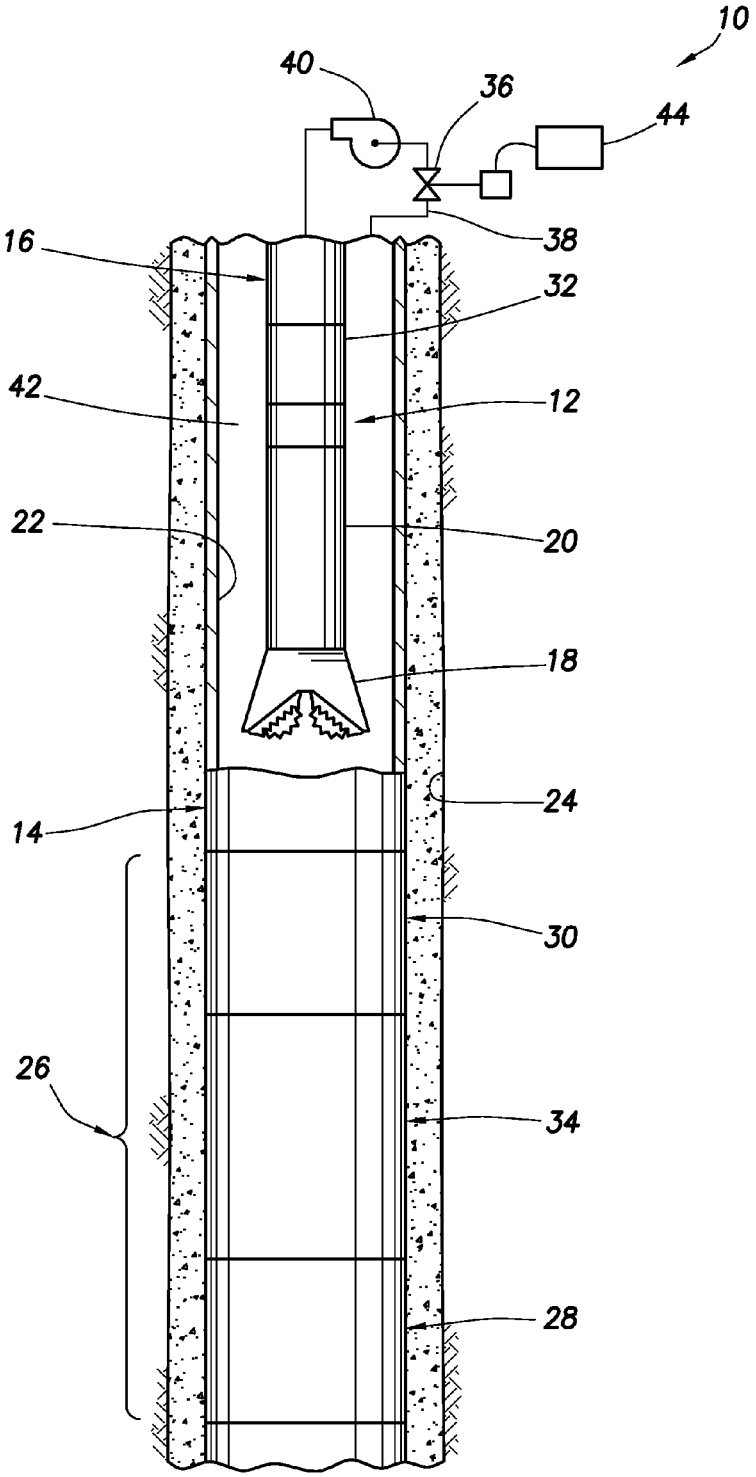
FIG. 1 is a representative partially cross-sectional view of a well system and associated method which embody principles of the present disclosure.

Representatively illustrated in FIG. 1 is an example of a well system 10 and associated method which embody principles of the present disclosure. In the system 10 as depicted in FIG. 1, an assembly 12 is conveyed through a tubular string 14 in a well.

The tubular string 14 forms a protective lining for a wellbore 24 of the well. The tubular string 14 may be of the type known to those skilled in the art as casing, liner, tubing, etc. The tubular string 14 may be segmented, continuous, formed in situ, etc. The tubular string 14 may be made of any material.

The assembly 12 is illustrated as including a tubular drill string 16 having a drill bit 18 connected below a mud motor and/or turbine generator 20. The mud motor/turbine generator 20 is not necessary for operation of the well system 10 in keeping with the principles of this disclosure, but is depicted in FIG. 1 to demonstrate the wide variety of possible configurations which may be used.

In the example of FIG. 1, a signal transmitter 32 is also interconnected in the tubular string 16. The signal transmitter 32 can be used to open an isolation valve 26 interconnected in the tubular string 14, as the assembly 12 is conveyed downwardly through the valve. The signal transmitter 32 can also be used to close the isolation valve 26 as the assembly 12 is retrieved upwardly through the valve.

The isolation valve 26 functions to selectively isolate upper and lower sections of the wellbore 24 from each other. In the example of FIG. 1, the isolation valve 26 selectively permits and prevents fluid communication through an internal flow passage 22 which extends longitudinally through the tubular string 14, including through the isolation valve.

As depicted in FIG. 1, the isolation valve 26 includes a detector section 30, a control system 34 and a valve/actuator section 28. The detector section 30 functions to detect a signal, for example, to open or close the isolation valve 26. The control system 34 operates the valve/actuator section 28 when an appropriate signal has been detected by the detector section 30.

Although the valve/actuator section 28, detector section 30 and control system 34 are depicted in FIG. 1 as being separate components interconnected in the tubular string 14, any or all of these components could be integrated with each other, additional or different components could be used, etc. The configuration of components illustrated in FIG. 1 is merely one example of a wide variety of possible different configurations.

The signal detected by the detector section 30 could be transmitted from any location, whether remote or local. For example, the signal could be transmitted from the transmitter 32 of the tubular string 16, the signal could be transmitted from any object (such as a ball, dart, tubular string, etc.) which is present in the flow passage 22, the signal could be transmitted from the detector section itself, the signal could be transmitted from the earth's surface, a subsea location, a drilling or production facility, etc.

In one example, a pressure pulse signal can be transmitted from a remote location (such as the earth's surface, a wellsite rig, a sea floor, etc.) by selectively restricting flow through a flow control device 36. The flow control device 36 is depicted schematically in FIG. 1 as a choke of the type used in a fluid return line 38 during drilling operations.

Fluid (such as drilling fluid or mud) is pumped by a rig pump 40 through the tubular string 16, the fluid exits the tubular string at the bit 18, and returns to the surface via an annulus 42 formed radially between the tubular strings 14, 16. By momentarily restricting the flow of the fluid through the device 36, pressure pulses can be applied to the isolation valve 26 via the passage 22. The timing of the pressure pulses can be controlled with a controller 44 connected to the flow control device 36.

Many other remote signal transmission means may be used, as well. For example, electromagnetic, acoustic and other forms of telemetry may be used to transmit signals to the detector section 30. Further examples of remote telemetry systems are described below in relation to FIG. 13.

Lines (such as electrical conductors, optical waveguides, hydraulic lines, etc.) can extend from the detector section 30 to remote locations for transmitting signals to the detector section. Such lines could be incorporated into a sidewall of the tubular string 14 (for example, so that the lines are installed as the tubular string is installed), or the lines could be positioned internal or external to the tubular string.

Of course, various forms of telemetry could be used for transmitting signals to the detector section 30, even if the signals are not transmitted from a remote location. For example, electromagnetic, magnetic, radio frequency identification (RFID), acoustic, vibration, pressure pulse and other types of signals may be transmitted from an object (which may include the transmitter 32) which is locally positioned (such as, positioned in the passage 22).

In one example described more fully below, an inductive coupling is used to transmit a signal to the detector section 30. An inductive coupling may also be used to recharge batteries in the isolation valve 26, or to provide electrical power for operation of the isolation valve without the need for batteries. Electrical power for operation of the inductive coupling could be provided by flow of fluid through the turbine generator 20 in one example.

In the system 10 as representatively illustrated in FIG. 1, the isolation valve 26 isolates a lower section of the wellbore 24 from an upper section of the wellbore while the tubular string 16 is being tripped into and out of the wellbore. In this manner, pressure in the lower section of the wellbore 24 can be more precisely managed, for example, to prevent damage to a reservoir intersected by the lower section of the wellbore, to prevent loss of fluids, etc.

The isolation valve 26 is not necessarily used only in drilling operations. For example, the isolation valve 26 may be used in completion operations to prevent loss of completion fluids during installation of a production tubing string, etc. It will be appreciated that there are a wide variety of possible uses for a selectively operable isolation valve.

Figure 2A:
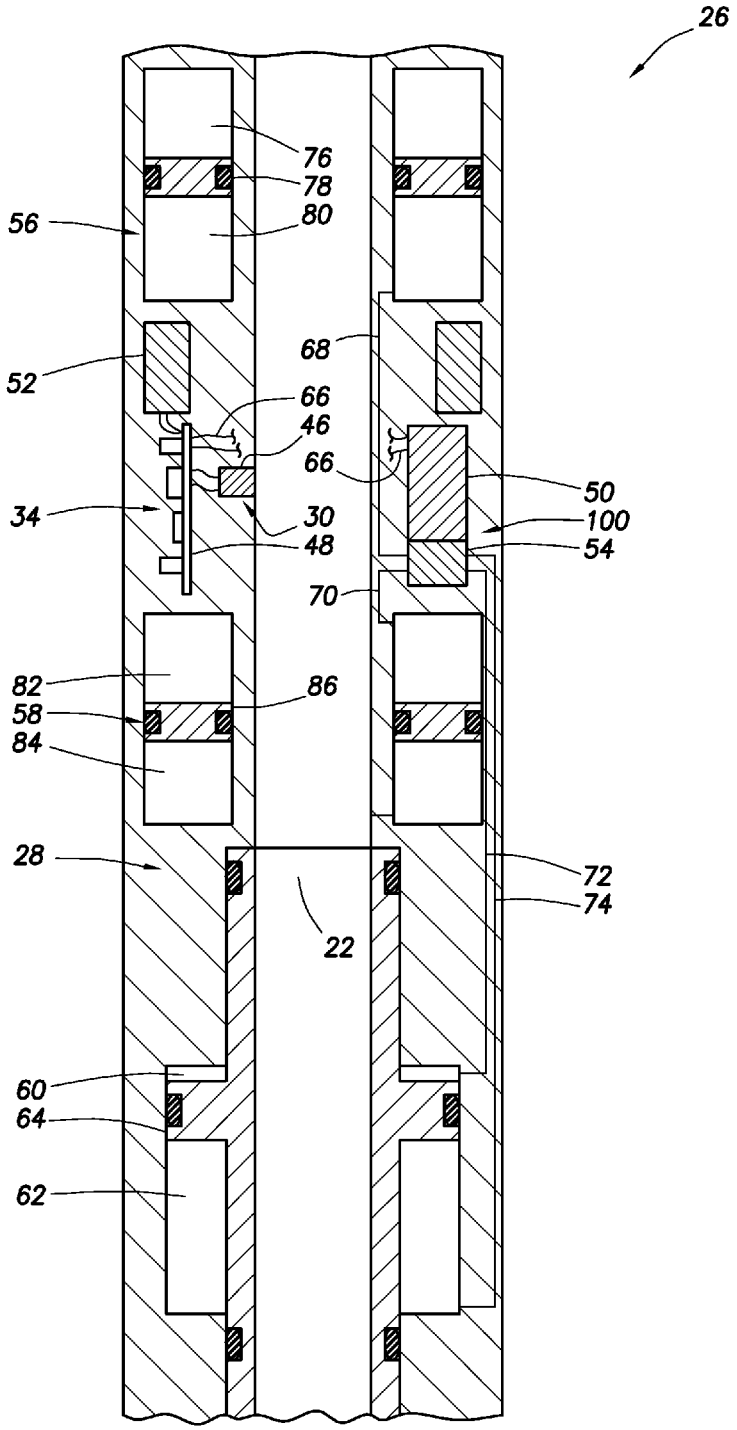
FIGS. 2A & B are representative enlarged scale cross-sectional views of an isolation valve which may be used in the system and method of FIG. 1, the isolation valve embodying principles of this disclosure, and the isolation valve being depicted in an open configuration.

Referring additionally now to FIGS. 2A & B, a schematic cross-sectional view of one example of the isolation valve 26 is representatively illustrated, apart from the remainder of the well system 10. In this example, the detector section 30, control system 34 and valve/actuator section 28 are incorporated into a single assembly, but any number or combination of components, subassemblies, etc. may be used in the isolation valve 26 in keeping with the principles of this disclosure.

The detector section 30 is depicted as including a detector 46 which is connected to electronic circuitry 48 of the control system 34. Electrical power to operate the detector 46, electronic circuitry 48 and a motor 50 is supplied by one or more batteries 52.

In other examples, the batteries 52 may not be used if, for example, electrical power is supplied via an inductive coupling. However, even if an inductive coupling is provided, the batteries 52 may still be used, in which case, the batteries could be recharged downhole via the inductive coupling.

The motor 50 is used to operate a rotary valve 54 which selectively connects pressures sources 56, 58 to chambers 60, 62 exposed to opposing sides of a piston 64. Operation of the motor 50 is controlled by the control system 34, for example, via lines 66 extending between the control system and the motor.

The pressure source 56 supplies relatively high pressure to the rotary valve 54 via a line 68. The pressure source 58 supplies relatively low pressure to the rotary valve 54 via a line 70. The rotary valve 54 is in communication with the chambers 60, 62 via respective lines 72, 74.

The high pressure source 56 includes a chamber 76 containing a pressurized, compressible fluid (such as compressed nitrogen gas or silicone fluid, etc.). A floating piston 78 separates the chamber 76 from another chamber 80 containing hydraulic fluid.

The low pressure source 58 similarly includes a floating piston 86 separating chambers 82, 84, with the chamber 82 containing hydraulic fluid. However, the chamber 84 is in fluid communication via a line 88 with a relatively low pressure region in the well, such as the passage 22.

Figure 3B:
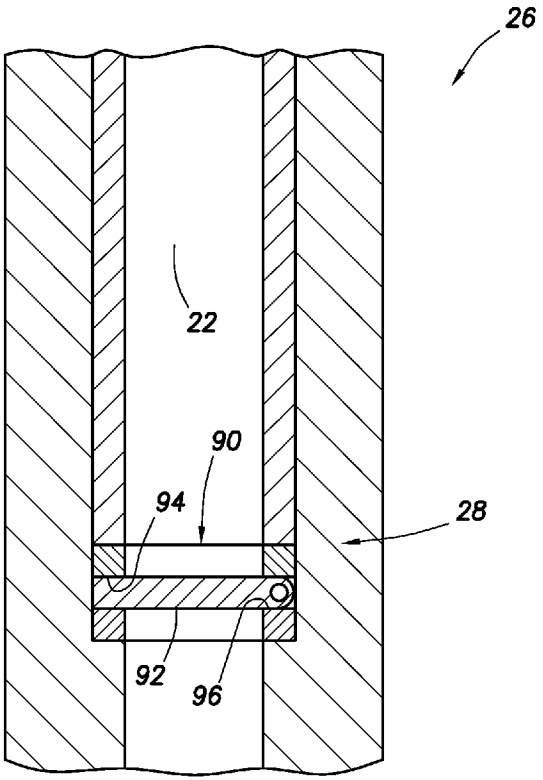
FIGS. 3A & B are representative cross-sectional views of the isolation valve, with the isolation valve being depicted in a closed configuration.
Figure 2B:
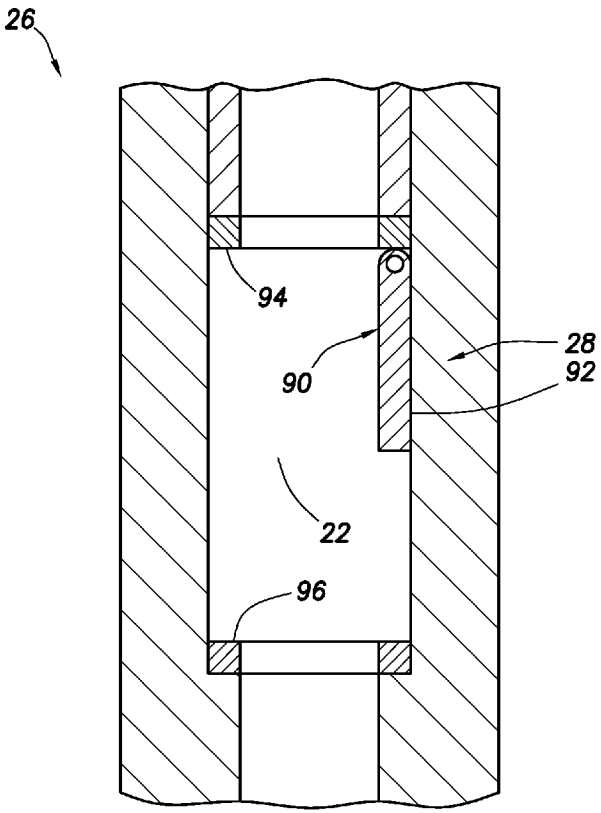
Figure 3A:
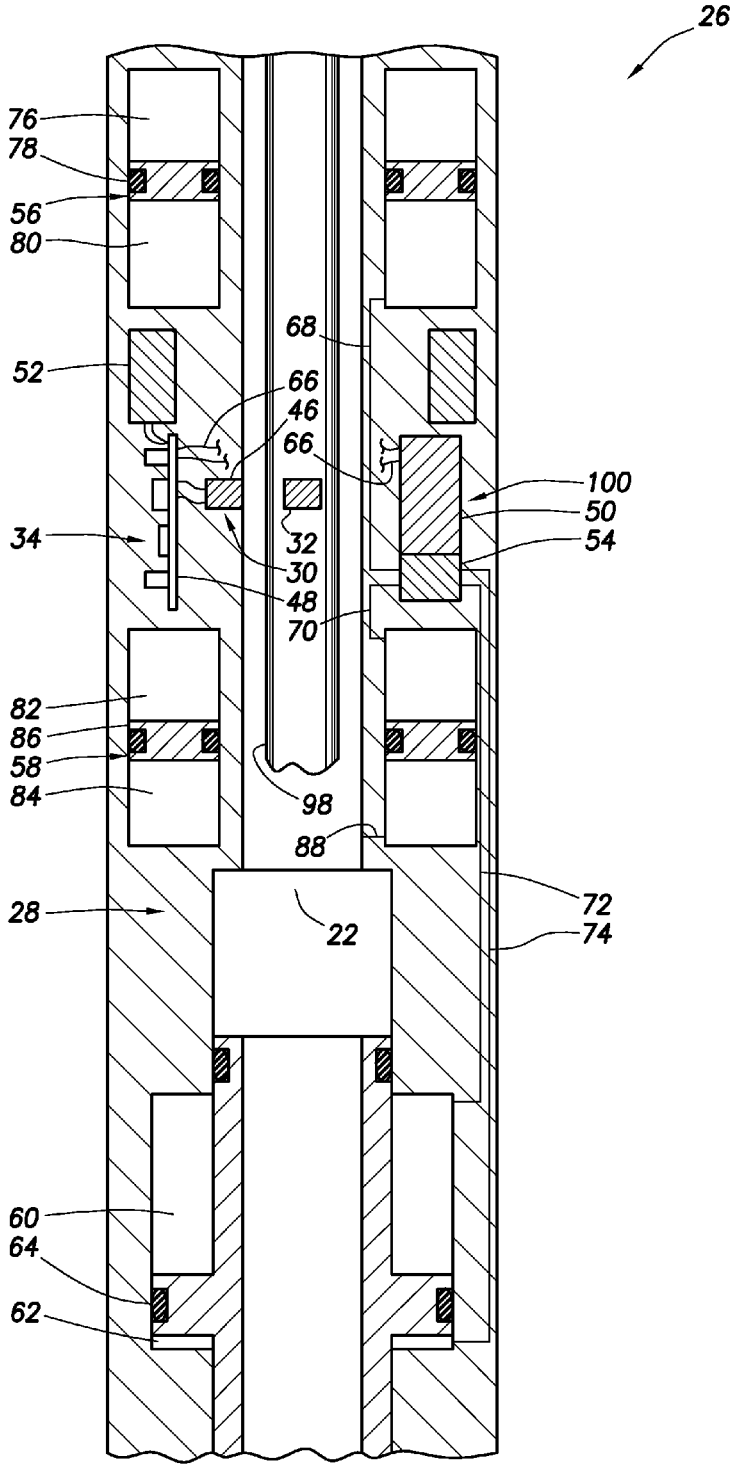

In the example of FIGS. 2A & B, a flapper valve 90 of the valve/actuator section 28 is opened when the piston 64 is in an upper position, and the flapper valve is closed (thereby preventing fluid communication through the passage 22) when the piston is in a lower position (see FIGS. 3A & B). Preferably, a flapper 92 of the valve 90 sealingly engages seats 94, 96 when the valve is closed, thereby preventing flow in both directions through the passage 22, when the valve is closed.

The pressure sources 56, 58, piston 64, chambers 60, 62, motor 50, rotary valve 54, lines 68, 70, 72, 74 and associated components can be considered to comprise an actuator 100 for operating the valve 90. To displace the piston 64 to its upper position, the rotary valve 54 is rotated by the motor 50, so that the high pressure source 56 is connected to the lower piston chamber 62, and the low pressure source 58 is connected to the upper piston chamber 60. Conversely, to displace the piston 64 to its lower position, the rotary valve 54 is rotated by the motor 50, so that the high pressure source 56 is connected to the upper piston chamber 60, and the low pressure source 58 is connected to the lower piston chamber 62.

As depicted in FIGS. 3A & B, an object 98 (such as a tubular string, bar, rod, etc.) is conveyed into the passage above the isolation valve 26. The object 98 includes the signal transmitter 32 which transmits a signal to the detector 46.

In response, the control system 34 causes the motor 50 to operate the rotary valve 54, so that relatively high pressure is applied to the lower piston chamber 62 and relatively low pressure is applied to the upper piston chamber 60. The piston 64, thus, displaces to its upper position (as depicted in FIGS. 2A & B), and the object 98 can then displace through the open valve 90, if desired.

Similarly, if the object 98 is retrieved through the open valve 90, then a signal transmitted from the transmitter 32 to the detector 46 can cause the control system 34 to operate the actuator 100 and close the valve 90 (i.e., by causing the motor 50 to operate the rotary valve 54, so that relatively high pressure is applied to the upper piston chamber 60 and relatively low pressure is applied to the lower piston chamber 62).

As depicted in FIG. 3B, the isolation valve 26 can selectively prevent fluid communication between sections of the wellbore 24, with the isolation valve 26 preventing fluid flow in each of first and second opposite directions through the flow passage 22 extending longitudinally through the isolation valve 26. Note that the flapper 92 is sealingly engaged with each of the seats 94, 96, thereby preventing fluid flow through the passage 22 in both upward and downward directions, as viewed in FIG. 3B.

Figure 4:
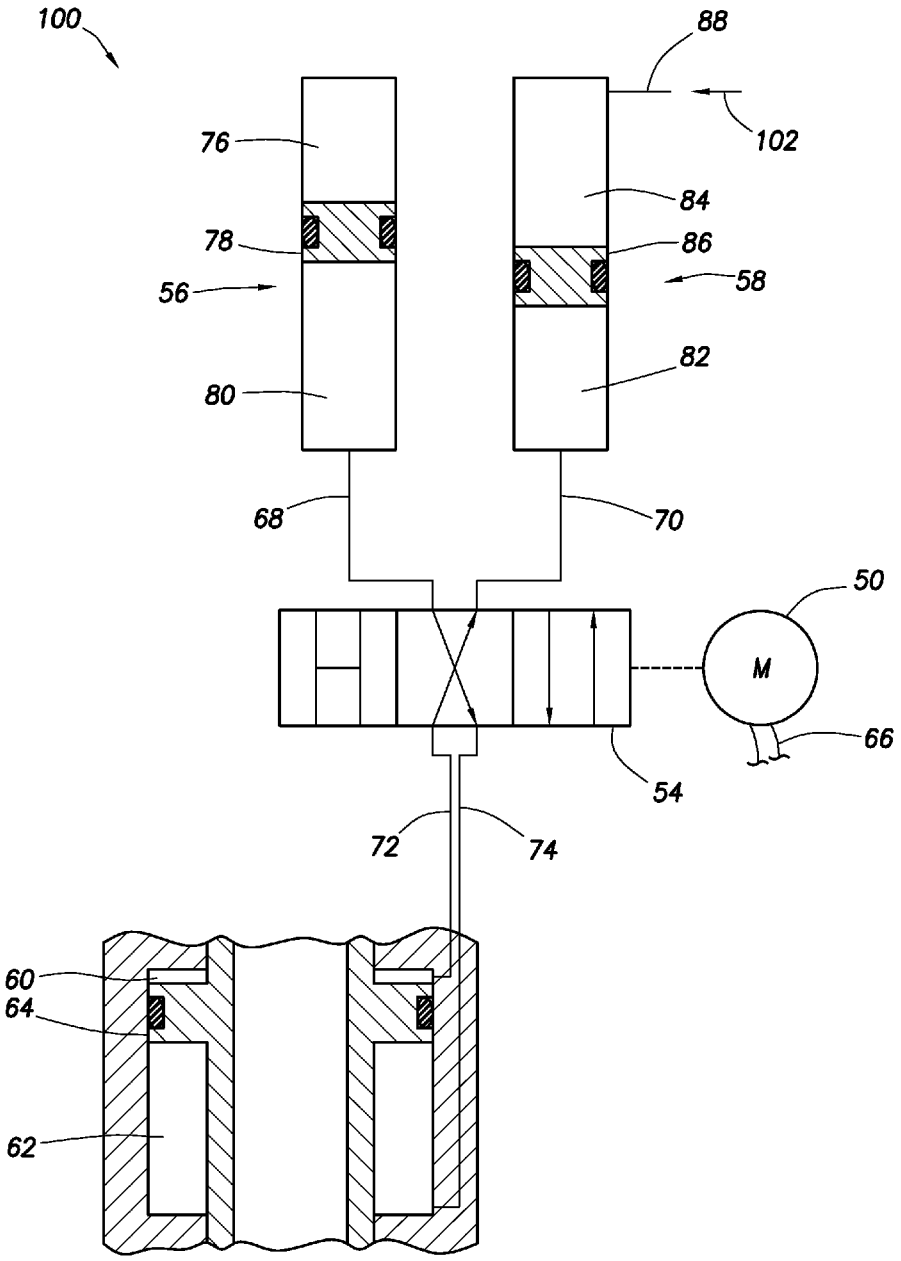
FIG. 4 is a representative hydraulic circuit diagram for an actuator of the isolation valve.

A schematic hydraulic circuit diagram for the actuator 100 is representatively illustrated in FIG. 4. In this circuit diagram, it may be seen that the rotary valve 54 is capable of connecting the lines 68, 70 to respective lines 74, 72 (as depicted in FIG. 4), is capable of connecting the lines 68, 70 to respective lines 72, 74 (i.e., reversed from that depicted in FIG. 4), and is capable of connecting all of the lines 68, 70, 72, 74 to each other.

The latter position of the rotary valve 54 is useful for recharging the high pressure source 56 downhole. With all of the lines 68, 70, 72, 74 connected to each other, pressure 102 applied via the line 88 to the chamber 84 will be transmitted to the chamber 76, which may become depressurized after repeated operation of the actuator 100.

It will be appreciated that, as the actuator 100 is operated to upwardly or downwardly displace the piston 64, the volume of the chamber 76 expands. As the chamber 76 volume expands, the pressure of the fluid therein decreases.

Eventually, the fluid pressure in the chamber 76 may be insufficient to operate the actuator 100 as desired. In that event, the rotary valve 54 may be operated to its position in which the lines 68, 70, 72, 74 are connected to each other, and elevated pressure 102 may be applied to the passage 22 (or other relatively low pressure region) to thereby recharge the chamber 76 by compressing it and thereby increasing the pressure of the fluid therein.

Figure 5A:
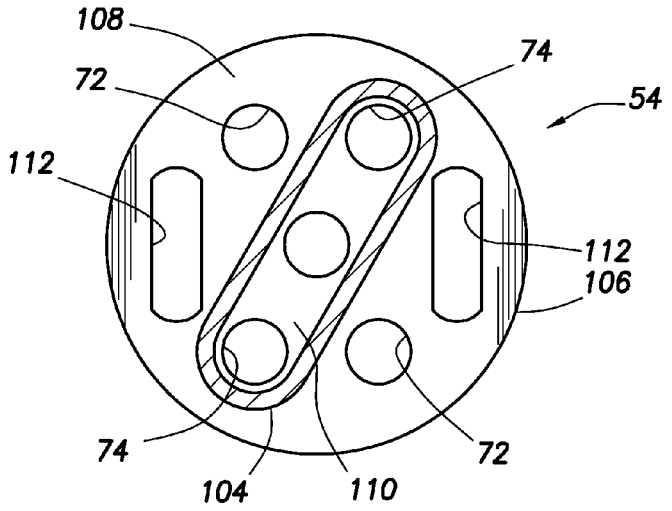
FIGS. 5A-C are enlarged scale representative partially cross-sectional views of various configurations of a rotary valve of the actuator.
Figure 5B:
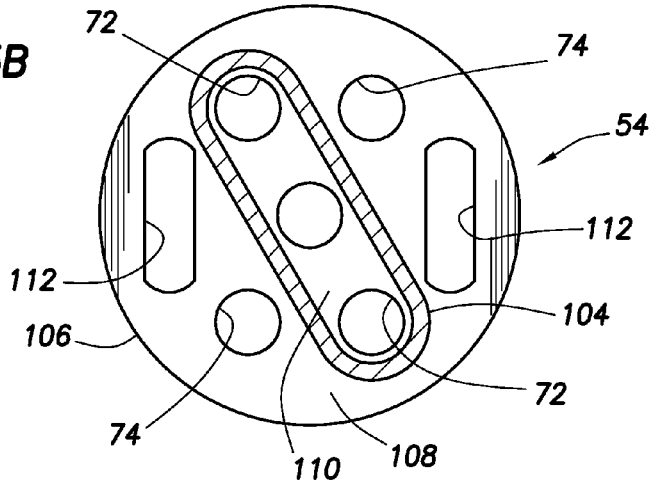
Figure 5C:
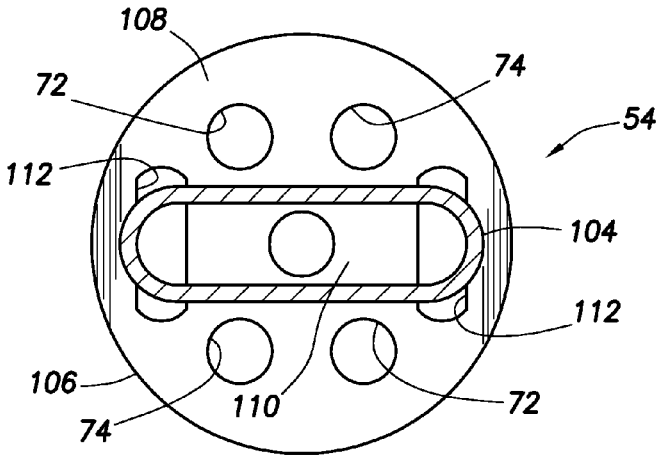

Referring additionally now to FIGS. 5A-C, enlarged scale schematic views of various positions of the rotary valve 54 are representatively illustrated apart from the remainder of the actuator 100. In these views, it may be seen that the rotary valve 54 includes a rotor 104 which sealingly engages a ported plate 106.

The sealing between the rotor 104 and the plate 106 is due to their mating surfaces being very flat, hardened and precisely ground, so that planar face sealing is accomplished. The rotor 104 is surrounded by a relatively high pressure region 108 (connected to the high pressure source 56 via the line 68), and a relatively low pressure region 110 (connected to the low pressure source 58 via the line 70), so the pressure differential across the rotor causes it to be biased into sealing contact with the plate 106.

As depicted in FIG. 5A, the rotor 104 is oriented relative to the plate 106 so that the lines 74 are in communication with the low pressure region 110 and the lines 72 are in communication with the high pressure region 108 (multiple lines 72, 74 are preferably used for balance and to provide more flow area, so that the valve 90 operates more quickly). Thus, the valve 90 will be closed, as shown in FIGS. 3A & B.

As depicted in FIG. 5B, the rotor 104 is oriented relative to the plate 106 so that the lines 74 are in communication with the high pressure region 108 and the lines 72 are in communication with the low pressure region 110. Thus, the valve 90 will be opened, as shown in FIGS. 2A & B.

As depicted in FIG. 5C, the rotor 104 is oriented so that ends of the rotor overlie shallow recesses 112 formed on the plate 106. In this position, the high and low pressure regions 108, 110 are in communication with each other, and in communication with each of the lines 72, 74. This is the position of the rotor 104 for recharging the chamber 76 as described above.

Note that the rotor 104 can reach the recharge position shown in FIG. 5C from the position shown in either of FIG. 5A or 5B. When the rotor 104 is in the position shown in FIG. 5C, there is no net change in pressure across the piston 64, and the valve 90 should remain in place without movement. For this reason, the chamber 76 can be recharged whether the valve 90 is in its open or closed position.

The motor 50 can rotate the rotor 104 to each of the positions depicted in FIGS. 5A-C as needed to operate the actuator 100, under control of the control system 34. However, note that it is not necessary for a motor 50 or rotary valve 54 to be used in the actuator 100 since, for example, a shuttle valve, a series of poppet or solenoid valves, or any other type of valving arrangement may be used, as desired.

Figure 6:
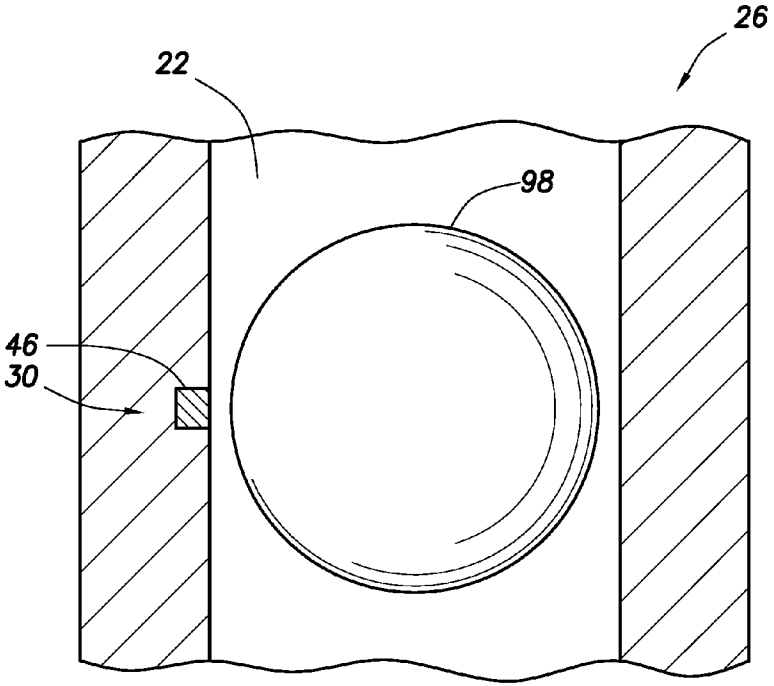

Referring additionally now to FIG. 6, an example of one method of detecting the presence of an object 98 in the passage 22 is representatively illustrated. Note that, in this example, the object 98 is in the shape of a ball, which may be dropped, circulated or otherwise conveyed through the passage 22 to the isolation valve 26, in order to open or close the valve. Any type of object (such as a ball, dart, tubular string, rod, bar, cable, wire, etc.) having any shape may be used in keeping with the principles of this disclosure.

As depicted in FIG. 6, the detector 46 of the detector section 30 detects the presence of the object 98 in the flow passage 22. In one example, the detector 46 could be an accelerometer or vibration sensor which detects vibrations caused by movement of the object 98 in the passage 22. In another example, the detector could be an acoustic sensor which detects acoustic noise generated by the movement of the object 98 in the passage 22. In other examples, the detector 46 could be a Hall effect sensor which detects a magnetic field of the object 98 (i.e., if the object is magnetized), a magnetic sensor which detects a change in a magnetic field strength due to the presence of the object 98 in the passage 22 (in which case the magnetic field could be generated by the isolation valve 26 itself), a pressure sensor which detects pressure signals (such as the pressure pulses generated by the flow control device 36, as described above), an acoustic sensor which detects acoustic signals transmitted through the passage 22 and/or the tubular string 14, other well components, etc., a radio frequency or other electromagnetic signal sensor, or any other type of signal detector.

Figure 7:
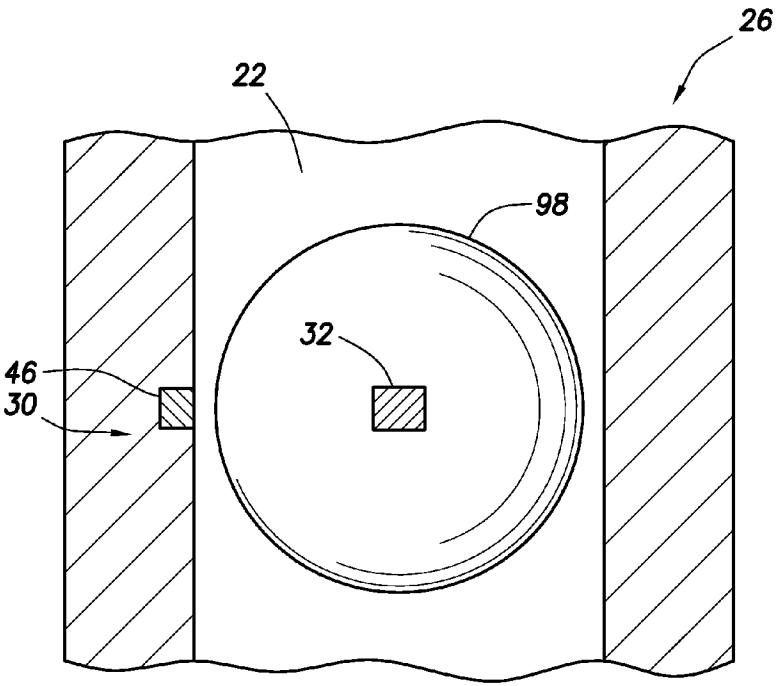
FIGS. 6-11 are representative partially cross-sectional views of additional configurations of a detector section of the isolation valve.

Representatively illustrated in FIG. 7 is yet another example, in which the signal transmitter 32 is incorporated into the object 98. A signal transmitted from the transmitter 32 to the detector 46 could be any type of signal, including acoustic, electromagnetic, magnetic, radio frequency identification (RFID), vibration, pressure pulse, etc.

Figure 8:
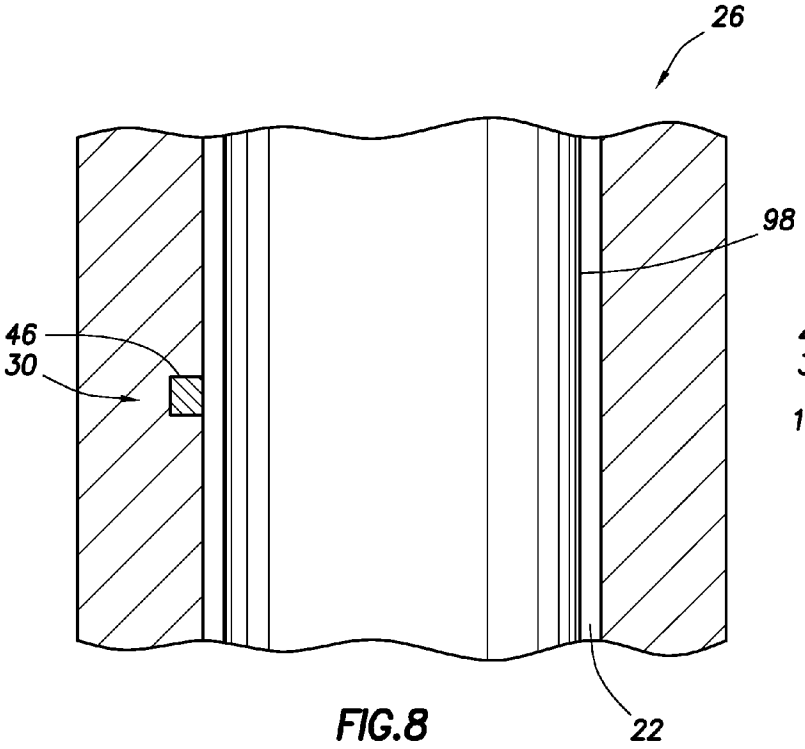

Representatively illustrated in FIG. 8 is a further example, in which the object 98 is in the form of a tubular string. The detector 46 comprises an acoustic transceiver (a combination of an acoustic signal transmitter and an acoustic signal receiver). The detector 46 detects the presence of the object 98 in the passage by detecting a reflection of an acoustic signal transmitted from the acoustic signal transmitter to the acoustic signal receiver, with the signal being reflected off of the object in the passage 22.

Figure 9:
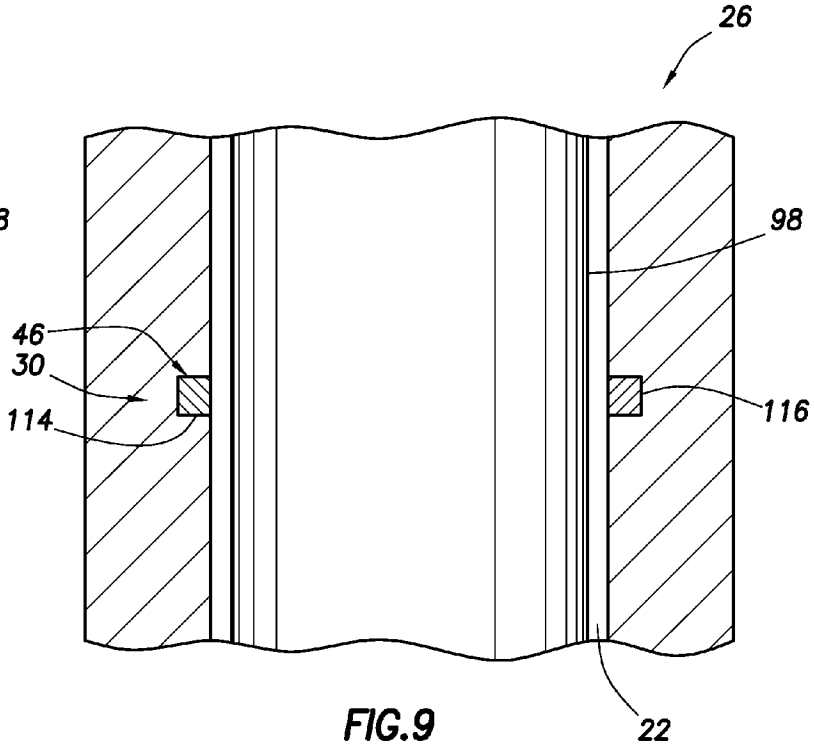

Representatively illustrated in FIG. 9 is another example, in which the object 98 is again in the form of a tubular string, but the detector 46 comprises a separate acoustic signal transmitter 114 and an acoustic signal receiver 116, preferably spaced apart from each other (e.g., on opposite sides of the passage 22). When the object 98 is appropriately positioned in the passage 22, an acoustic signal transmitted by the transmitter 114 is interrupted by the object, so that it is not received by the receiver 116 (or the received signal is delayed and/or distorted, etc.), and the detector 46 is thereby capable of detecting the presence of the object.

Figure 10:
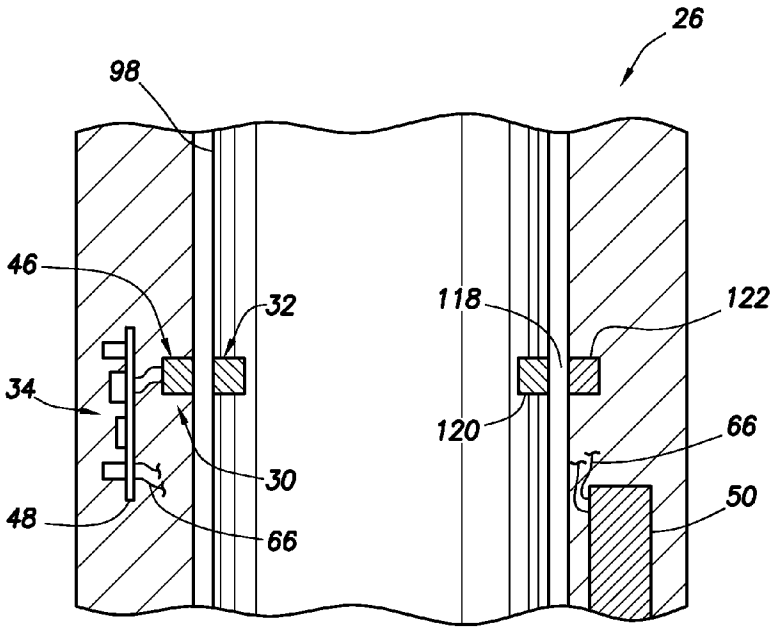

Representatively illustrated in FIG. 10 is another example, in which an inductive coupling 118 is formed between the object 98 and the detector section 30. More specifically, the signal transmitter 32 includes a coil 120 which inductively couples with a coil 122 of the detector 46.

Data and/or command signals may be transmitted from the signal transmitter 32 to the detector 46 via the inductive coupling 118. Alternatively, or in addition, the inductive coupling 118 may be used to transmit electrical power to charge the batteries 52. As depicted in FIG. 10, the isolation valve 26 may even be operated without the use of batteries 52, if sufficient electrical power can be transmitted via the inductive coupling 118.

Figure 11:
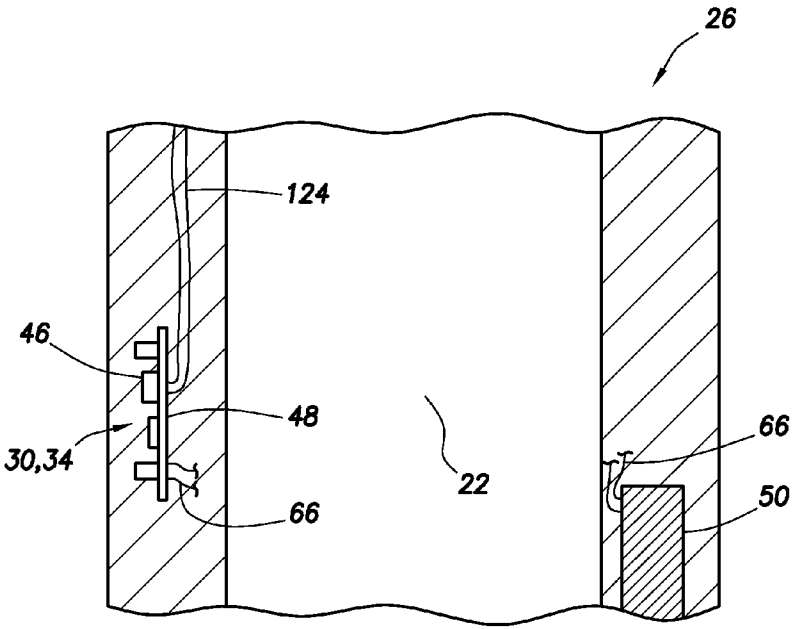

Representatively illustrated in FIG. 11 is another example in which signals to operate the isolation valve 26 may be transmitted via one or more lines 124 extending to a remote location. The lines 124 could be electrical, optical, hydraulic or any other types of lines.

In the example of FIG. 11, the lines 124 are connected directly to a combined detector section 30 and control system 34. For example, the detector 46 could be a component of the electronic circuitry 48.

The lines 124 may extend to the remote location in a variety of different manners. In one example, the lines 124 could be incorporated into a sidewall of the tubular string 14, or they could be positioned external or internal to the tubular string.

Figure 12:
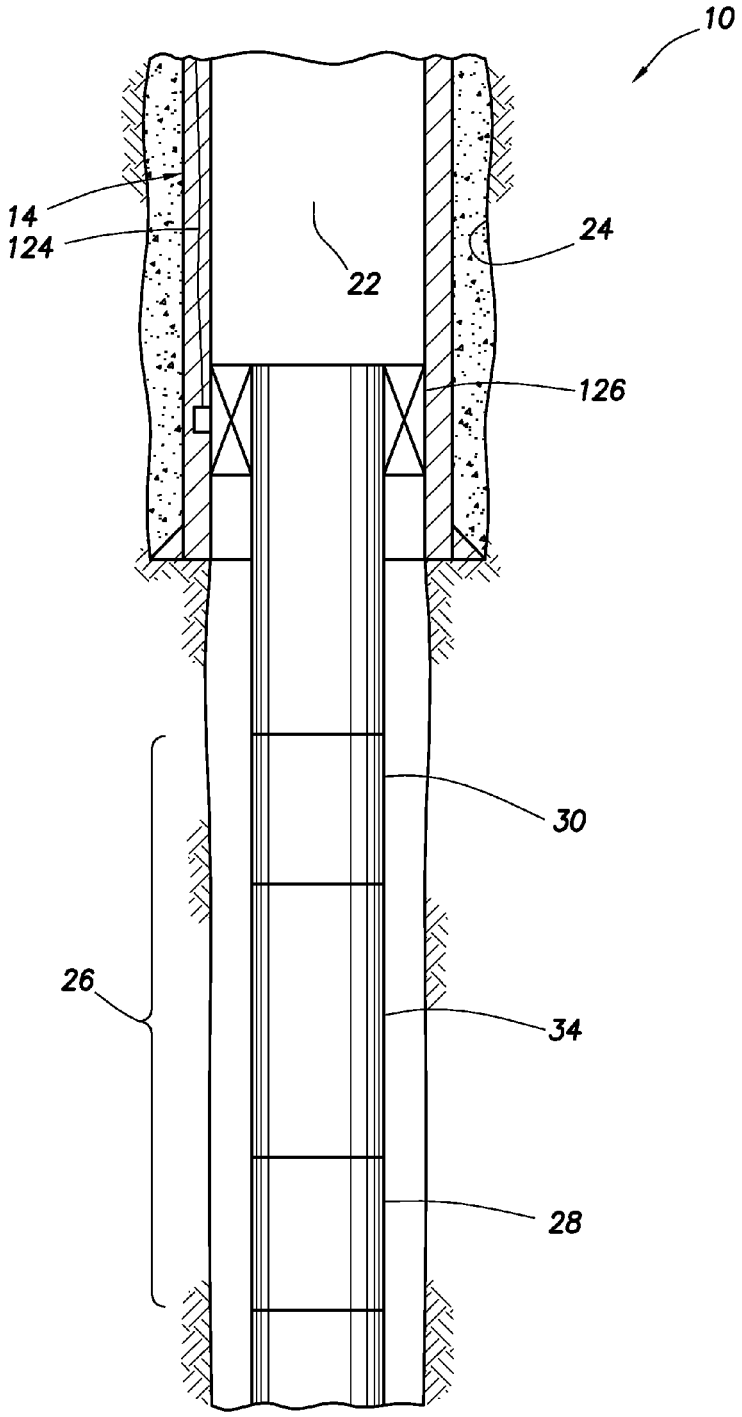
FIG. 12 is a representative partially cross-sectional view of another configuration of the system and method of FIG. 1.

Referring additionally now to FIG. 12, another configuration of the well system 10 is representatively illustrated, in which the isolation valve 26 is secured to the tubular string 14 by means of a releasable anchor 126 (for example, in the form of a specialized liner hanger). If the lines 124 are used for transmitting signals to the isolation valve 26, then setting the anchor 126 may result in connecting the lines 124 to the detector section 30 and/or control system 34.

When desired, the isolation valve 26 may be retrieved from the wellbore 24 by releasing the anchor 126. In this manner, the valuable isolation valve 26 may be used again in other wells.

Note that, in the configuration of FIG. 12, the isolation valve 26 provides for selective fluid communication and isolation between cased and uncased sections of the wellbore 24. In other examples (such as the example of FIG. 1), the isolation valve 26 may provide for selective fluid communication and isolation between two cased sections of a wellbore, or between two uncased sections of a wellbore.

Figure 13:
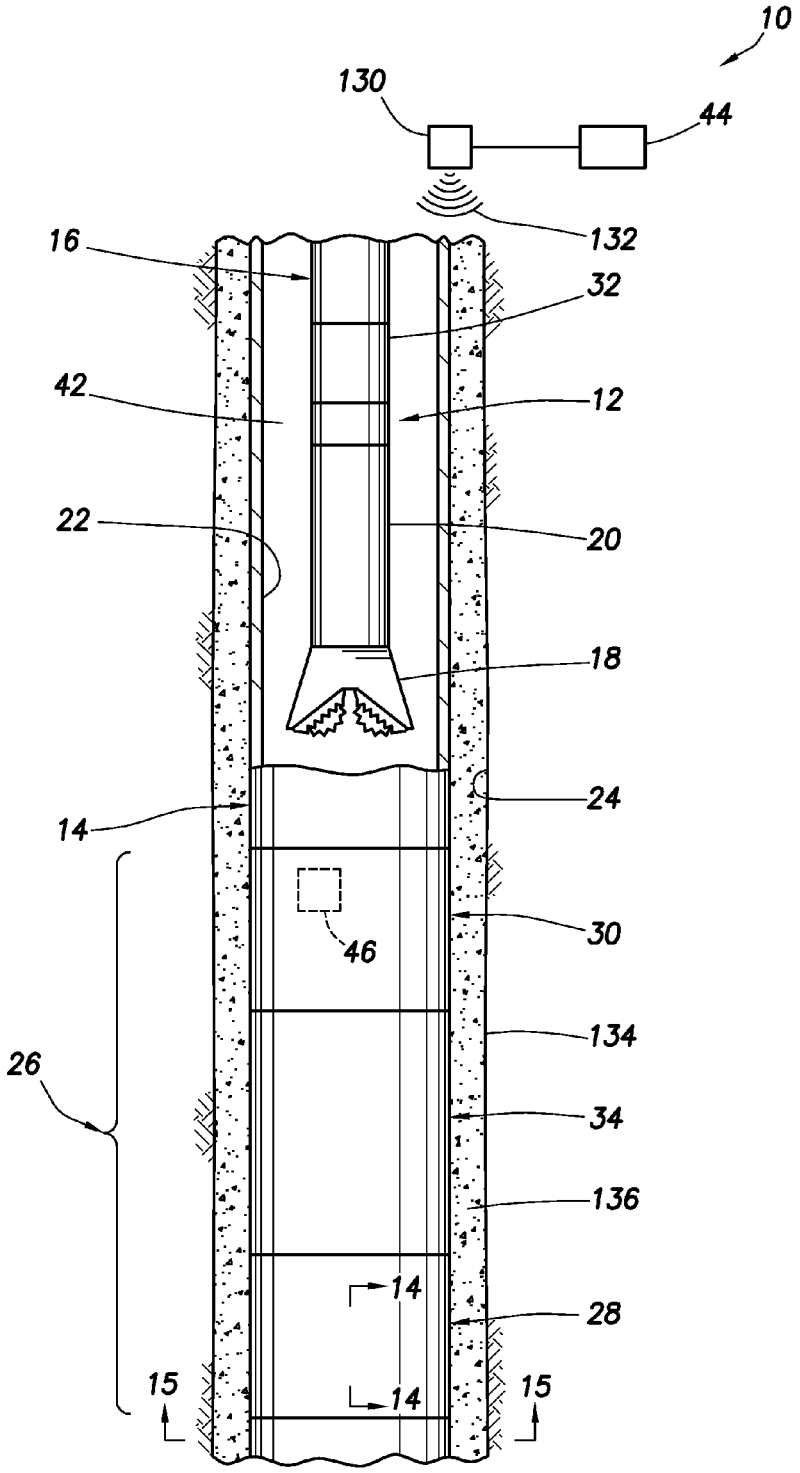
FIG. 13 is a representative partially cross-sectional view of another configuration the system and method of FIG. 1.

Referring additionally now to FIG. 13, another configuration of the well system 10 is representatively illustrated. In this configuration, the controller 44 is connected to a signal transmitter 130 positioned at a location remote from the isolation valve 26. The remote location could be at the earth's surface, a subsea or sea floor location, a wellhead, a rig, a production or drilling facility, etc.

The transmitter 130 transmits a signal 132 to the isolation valve 26. The signal 132 could be an acoustic, electromagnetic, radio frequency, pressure pulse, or other type signal.

In this example, the signal 132 is continuously transmitted, in order to maintain a particular actuation of the isolation valve 26. Thus, the signal 132 may be continuously transmitted to maintain the isolation valve 26 in an open or closed configuration.

Such an arrangement can be beneficial, for example, in an emergency situation to prevent inadvertent escape of well fluids from the well. In that case, the isolation valve 26 could be configured so that it closes when transmission of the signal 132 ceases. In that way, release of well fluids from the well could be prevented by closing the valve 26 in response to an interruption in transmission of the signal 132.

"Continuous" transmission of the signal 132 can include regular or periodic transmission of the signal according to a preselected pattern (e.g., transmission every 3 minutes, etc.). Thus, the valve 26 could actuate to its open or closed configuration in response to an interruption in regular or periodic transmission of the signal according to the preselected pattern.

In the example of FIG. 13, the signal 132 is transmitted to the isolation valve 26. The signal 132 is detected by the detector 46 of the detector section 30.

As long as the signal 132 is continuously detected by the detector 46, the control system 34 maintains the valve/actuator section 28 in its current configuration (e.g., open or closed). When the signal 132 is not continuously detected, the control system 34 causes the valve/actuator section 28 to change its configuration (e.g., from open to closed, or from closed to open).

Note that, in FIG. 13, the isolation valve 26 is cemented in the wellbore 24. Cement 134 is positioned in an annulus 136 formed radially between the isolation valve 26 and the wellbore 24. However, in other examples (such as, similar to that depicted in FIG. 12), the isolation valve 26 may not be cemented in the wellbore 24.

Figure 14:
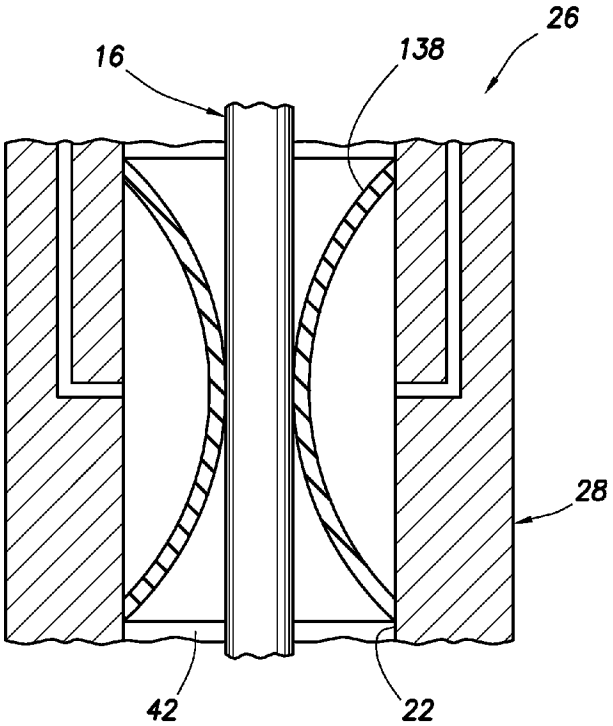
FIG. 14 is a representative partially cross-sectional view of an annular seal of the isolation valve, taken along line 14-14 of FIG. 13.

The valve/actuator section 28 in the examples described above could include the flapper valve 90, a ball valve (e.g., a ball valve capable of severing cable or pipe in the passage 22), or any other type of valve. In FIG. 14, the valve/actuator section 28 is depicted as including a resilient annular seal 138 which can be extended inward to seal against an outer surface of the drill string 16 or other tubular in the passage 22.

In this respect, the seal 138 can be similar to those used in annular blowout preventers. The seal 138, when sufficiently extended radially inward, seals off the annulus 42.

Figure 15:
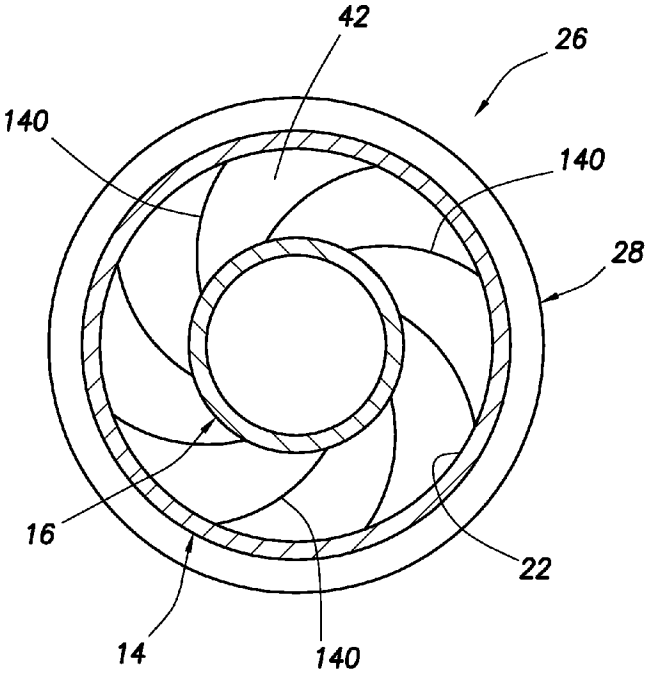
FIG. 15 is a representative partially cross-sectional view of an alternate annular seal of the isolation valve, taken along line 15-15 of FIG. 13.

In FIG. 15, another means of sealing off the annulus 42 is representatively illustrated. The valve/actuator section 28 depicted in FIG. 15 includes iris-type overlapping leaves 140 which can be extended radially inward to seal against the drill string 16 or other tubular in the passage 22.

Using the configurations of FIGS. 14 & 15, reservoir damage, loss of drilling fluid, inadvertent escape of well fluid, etc., can be prevented by closing off the passage 22, or the annulus 42 if the drill string 16 or other structure is in the passage. The passage 22 or annulus 42 can be sealed off (e.g., using the configuration of FIG. 13), if continuous transmission of the signal 132 ceases.

The signal 132 can also be used to actuate the isolation valve 26, without ceasing transmission of the signal 132. For example, the signal 132 could be modulated in various ways to cause the isolation valve 26 to open when desired (such as, to allow the drill string 16 to extend through the valve/actuator section 28, etc.), to close when desired (such as, to isolate sections of the wellbore 24 from each other, to prevent reservoir damage, to prevent loss of drilling or completion fluids, to prevent inadvertent loss of well fluids from the well, etc.), to recharge the chamber 76 when desired, etc.

Although the principles of this disclosure have been described above in relation to several specific separate examples, it will be readily appreciated that any of the features of any of the examples may be conveniently incorporated into, or otherwise combined with, any of the other examples. Thus, the individual examples are not in any manner intended to demonstrate mutually exclusive features. Instead, the multiple examples demonstrate that the principles of this disclosure are applicable to a wide variety of different applications.

It may now be fully appreciated that the above disclosure provides many advancements to the art. The examples of systems and methods described above can provide for convenient and reliable isolation between sections of a wellbore, as needed.

Specifically, the above disclosure provides to the art a method of operating an isolation valve 26 in a subterranean well. The method can include continuously transmitting a signal 132 to a detector section 30 of the isolation valve 26, and a control system 34 of the isolation valve 26 operating an actuator 100 of the isolation valve 26 in response to the detector section 30 detecting that continuous transmission of the signal 132 has ceased.

The signal 132 may be transmitted from a remote location. The signal 132 can be transmitted from the remote location via telemetry. The telemetry may be one or more of electromagnetic, acoustic, and pressure pulse telemetry.

Continuously transmitting the signal 132 can include maintaining a configuration of the isolation valve 26 unchanged. Operating the actuator 100 of the isolation valve 26 may include changing the configuration of the isolation valve 26.

The isolation valve 26 may be cemented in a wellbore 24. Cement 134 may be positioned in an annulus 136 formed between the isolation valve 26 and a wellbore 24.

Also described above is a well system 10. The well system 10 can include an isolation valve 26 which selectively permits and prevents fluid communication between sections of a wellbore 24, a signal transmitter 130 which transmits a signal 132, the signal transmitter 130 being positioned remotely from the isolation valve 26, the isolation valve 26 including a detector section 30 which detects the signal 132, and the isolation valve 26 further including a control system 34 which operates an actuator 100 of the isolation valve 26 in response to detection of the signal 132 by the detector section 30.

Another well system 10 described above can include an isolation valve 26 which selectively permits and prevents fluid communication between sections of a wellbore 24, the isolation valve 26 being interconnected in a tubular string 14, and the tubular string 14 being cemented in the wellbore 24, with cement 134 being disposed in an annulus 136 formed radially between the isolation valve 26 and the wellbore 24.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of operating an isolation valve in a subterranean well, the method comprising:

interconnecting the isolation valve between ends of a casing string located in the wellbore;

continuously transmitting a signal to a detector section of the isolation valve; and energizing an actuator of the isolation valve via a control system in response to the detector section detecting that continuous transmission of the signal has ceased.

2. The method of claim 1, wherein the signal is transmitted from a remote location.

3. The method of claim 2, wherein the signal is transmitted from the remote location via telemetry.

4. The method of claim 3, wherein the telemetry comprises at least one of the group consisting of electromagnetic, acoustic, and pressure pulse telemetry.

5. The method of claim 1, wherein the transmitting further comprises maintaining a configuration of the isolation valve unchanged.

6. The method of claim 5, wherein energizing the actuator further comprises changing the configuration of the isolation valve.

7. The method of claim 1, wherein the isolation valve is cemented in a wellbore.

8. The method of claim 7, wherein cement is positioned in an annulus formed between the isolation valve and the wellbore.

9. A well system, comprising:

an isolation valve interconnected between ends of a casing string located in a wellbore which selectively permits and prevents fluid communication between sections of a wellbore;

a signal transmitter which transmits a signal, the signal transmitter being positioned remotely from the isolation valve;

the isolation valve including a detector section which detects the signal; and the isolation valve further including a control system which energizes an actuator of the isolation valve in response to cessation of the signal.

10. The well system of claim 9, wherein the control system electrically energizes the actuator in response to detection of the signal by the detector section.

11. The well system of claim 10, wherein the control system maintains a configuration of the isolation valve unchanged in response to continuous transmission of the signal.

12. The well system of claim 11, wherein the control system changes the configuration of the isolation valve in response to interruption of the continuous transmission of the signal.

13. The well system of claim 9, wherein the signal is transmitted from the remote location via telemetry.

14. The well system of claim 13, wherein the telemetry comprises at least one of the group consisting of electromagnetic, acoustic, and pressure pulse telemetry.

15. The well system of claim 9, wherein the isolation valve is cemented in a wellbore.

16. The well system of claim 15, wherein cement is positioned in an annulus formed between the isolation valve and the wellbore.

17. A well system, comprising:

an isolation valve interconnected between ends of a casing string located in a wellbore which selectively permits and prevents fluid communication between sections of a wellbore;

the isolation valve being interconnected in a tubular string; and the tubular string being cemented in the wellbore, with cement being disposed in an annulus formed radially between the isolation valve and the wellbore, wherein the isolation valve includes a detector section which detects a signal, and a control system which energizes an actuator in response to detection of the signal by the detector section, thereby rotating a rotary valve of the isolation valve to a first position, whereby the fluid communication is permitted, and wherein the control system electrically energizes the actuator in response to detection that transmission of the signal has ceased, thereby rotating the rotary valve to a second position, whereby the fluid communication is prevented.

18. The well system of claim 17, further comprising a signal transmitter which transmits the signal, the signal transmitter being positioned at a location remote from the isolation valve.

19. The well system of claim 18, wherein the signal is transmitted from the remote location via telemetry.

20. The well system of claim 19, wherein the telemetry comprises at least one of the group consisting of electromagnetic, acoustic, and pressure pulse telemetry.

21. The well system of claim 17, wherein the control system maintains a configuration of the isolation valve unchanged in response to continuous transmission of the signal.

22. The well system of claim 21, wherein the control system changes the configuration of the isolation valve in response to interruption of the continuous transmission of the signal.

* * * * *